US008061523B2

(12) United States Patent
Uebayashi et al.

(10) Patent No.: US 8,061,523 B2
(45) Date of Patent: Nov. 22, 2011

(54) PURIFIER

(75) Inventors: Shigeki Uebayashi, Tokyo (JP); Masakazu Kobayashi, Tokyo (JP); Takuji Nakano, Tokyo (JP)

(73) Assignee: Satake Corporation, Tokyo (JP)

( * ) Notice: Subject to any disclaimer, the term of this patent is extended or adjusted under 35 U.S.C. 154(b) by 113 days.

(21) Appl. No.: 12/662,090

(22) Filed: Mar. 30, 2010

(65) Prior Publication Data

US 2010/0243538 A1 Sep. 30, 2010

(51) Int. Cl.
*B07B 9/00* (2006.01)

(52) U.S. Cl. ..... 209/21; 209/20; 209/26; 209/312; 209/321

(58) Field of Classification Search ..... 209/20, 209/21, 26, 312, 321
See application file for complete search history.

(56) References Cited

U.S. PATENT DOCUMENTS 2,217,710 A * 10/1940 Shaler ..... 209/28
4,636,305 A * 1/1987 Mueller ..... 209/312
4,806,235 A * 2/1989 Mueller ..... 209/321
5,348,161 A * 9/1994 Mueller ..... 209/29
6,103,415 A * 8/2000 Kurita et al. ..... 429/444

FOREIGN PATENT DOCUMENTS

| | | |
|---|---|---|
| EP | 0 334 180 | 3/1989 |
| JP | 01-013916 B2 | 3/1989 |
| JP | 01-013917 B2 | 3/1989 |
| JP | 01-022827 B2 | 4/1989 |
| JP | 08-039002 | 2/1996 |

* cited by examiner

*Primary Examiner* — Terrell Matthews
(74) *Attorney, Agent, or Firm* — Staas & Halsey LLP

(57) ABSTRACT

A purifier is provided that is capable of uniformly sucking powder in a width direction of the sieve layers even when the purifier is configured to be provided with an air distribution chamber formed as being tapered upward and to have a horizontal cyclone provided above the air distribution chamber. The air distribution chamber is configured of paired inclined surfaces formed as being tapered upward, has a suction passage formed as a horizontal cyclone placed above the air distribution chamber. Also, a plurality of barrier walls are provided in the air distribution chamber in a direction perpendicular to a longitudinal direction of sieve layers, the air distribution chamber is sectioned by the barrier walls into a plurality of chambers, and rectifying plates are further provided to the air distribution chamber at a narrow position between the paired inclined surfaces to prevent non-uniformity of suction of powder on the sieve layers.

9 Claims, 15 Drawing Sheets

PURIFIER

BACKGROUND OF THE INVENTION

1. Field of the Invention

The present invention relates to a purifier that separates overtail rich with bran (skin portion) from semolina (fragments of varying particle size) or middlings (relatively coarse albumen particles fragmented by a brake roll) produced in a flour-milling process by using a vibrating operation of sieves and an action of an air flow passing from a lower portion to an upper portion of the sieves to obtain pure semolina.

2. Description of Related Art

An example of a conventional purifier is disclosed in Japanese Examined Patent Publication No. 1-22827 (refer to FIG. 18). This purifier has an air distribution chamber 122 on a sieve layer 103. The air distribution chamber 122 is provided with a plurality of air guide chambers 124 formed of inclined surfaces 111 of the air distribution chamber 122 inclined in a direction of gathering an air flow from the sieve layer 103 and barrier walls 123. These air guide chambers 124 reach near the top sieve layer 103. On the air distribution chamber 122, a suction passage 127 formed of a horizontal cyclone is placed. Furthermore, a transition portion from the air distribution chamber 122 to the suction passage 127 is constructed toward a tangent direction of the suction passage 127 so that an air flow gathered by the inclined surfaces of the air distribution chamber 122 directly forms a swirl with respect to the suction passage 127. At this transition portion, an aperture 128 is disposed.

With this, a cyclone flow occurs in the suction passage 127 by the tangent-direction transition portion. For example, in the suction passage 127, a strong swirl is formed on one side irrespectively of the degree of opening of the aperture 128, thereby achieving an effect of reliably keeping the machine clean without deposition of dust and other particles or clogging of the aperture opening.

However, in the purifier described in Japanese Examined Patent Publication No. 1-22827, the suction force near the center of the sieve layer 103 in a width direction (an X direction) is strong, while the suction force near both ends in the width direction is weak, thereby making it difficult to uniformly suck powder in the width direction.

Another example of the conventional purifier is disclosed in European Patent Application Publication No. EP0334180 A2. In the purifier disclosed in European Patent Application Publication No. EP0334180 A2, at least one box-like body is rigidly coupled onto a base via elastic elements. The box-like body has two rows of three stacked sifters provided at its middle position, at least one suction hood provided at an upper position, and at least one product collector provided at a lower position.

On the other hand, Japanese Unexamined Patent Application Publication No. 8-39002 discloses a purifier that has pressing bodies for sieves. That is, in paragraph [0013], "A screening device 2 of a purifier 1 has sieve nets 6 multi-layered in three layers . . . . The rear ends 6, 6, 6 of the sieve nets formed in three layers are fixed by sieve pressing bodies 12A, 12B, 12C, respectively, with the pressing body 12A being provided with an opening 13A, the pressing body 12B being provided with an opening 13B, and the pressing body 12C being provided with an opening 13C. The openings 13A, 13B, 13C communicate with a takeout gutter 14 via delivery gutters 8A, 8B, 8C, respectively". The openings 13A, 13B, 13C provided by piercing the pressing bodies 12 of the respective stages have a separating function of guiding overtail to the discharge gutters 8 for each sieve net 6, and the pressing body 12 at each stage has a sealing function for preventing a leak of powder.

However, in the pressing bodies for the sieve nets described in Japanese Unexamined Patent Application Publication No. 8-39002, after the sieve nets 6 are inserted in a housing, the pressing bodies merely close the opening of that housing for clamping, and are not configured to be able to adjust the pressing force. Therefore, for example, when a plurality of sieve nets with different meshes (wire gauges) are disposed in one layer (in the purifier disclosed in Japanese Unexamined Patent Application Publication No. 8-39002, four sieve nets are disposed in a stock-moving direction), if the pressing force cannot be adjusted, the pressed contact action between the sieve nets is insufficient, resulting in the occurrence of "rattle", which puts the purifier under violent vibrations at screening. Thus, the sealing function for preventing a leak of powder disadvantageously becomes insufficient.

Still another example of the conventional purifier is disclosed in Japanese Examined Patent Publication Nos. 1-13916 and 1-13917. The purifier disclosed in these patent gazettes and also in Japanese Examined Patent Publication No. 1-22827 has a vibration mechanism, which is now described below with reference to FIGS. 18 to 20. The purifier has a duplex structure in which three stacked sieve layers 103 are unitized as one screening box 108 and two screening boxes 108 are arranged in two rows. Each screening box 108 is supported by an end support 112 onto a support base leg 110 of a support base 109 via a hollow rubber spring 113, and an unbalanced vibration generating device 114 is coupled stiff to the end supports 112. Each screening box 108 can generate linear vibration in a direction indicated by an arrow A in FIG. 19, while the support base leg 110, a column 121, the air distribution chamber 122, a support base head 111, and the suction passage 127, in FIG. 20, all of which are non-vibration components, are not vibrated.

In the purifier disclosed in Japanese Examined Patent Publication Nos. 1-13916, 1-13917, and 1-22827, two vibration generating devices vibrating in reverse directions are used to produce a vibrating motion in a straight inclined direction indicated by the arrow A in FIG. 19. However, supported by the hollow rubber springs 113 inserted in four end supports 112, the screening boxes 108 can freely move in an axial direction (a direction indicated by an arrow Y) and a lateral direction (a direction indicated by an arrow X) of the end supports 112 (refer to FIG. 20).

That is, during a period in which a small number of vibration at the time of starting and stopping the operation, the vibrating direction is unstable, and rolling of the screening boxes 108 occurs not only in the original linear vibrating direction (a direction indicated by an arrow A in FIG. 19) but also in a direction indicated by an arrow X in FIG. 20 (a depth direction in FIG. 19) to cause load stress to repeatedly act on the plurality of non-vibration components, possibly leading to fatigue breakdown.

SUMMARY OF THE INVENTION

In view of the above-described problems, a technical object of the present invention is to provide a purifier capable of uniformly sucking powder in a width direction of sieve layers even when the purifier is configured to be provided with an air distribution chamber formed as being tapered upward and to have a horizontal cyclone provided above the air distribution chamber, and is also to solve the above-described problems regarding the purifier.

To achieve the above-described object, a purifier is provided as technical means, in which a plurality of sieve layers stacked each other are accommodated in a sieve box as being mounted in an inclined manner, the sieve box is supported by at least four legs onto a support base as a non-vibration component, the sieve box is coupled to a vibration generating device so as to be able to vibrate in a longitudinal direction of the sieve box and communicates with a unit of supplying a material required to be screened on an upstream side of the sieve box and an overtail discharge unit on a downstream side of the sieve box, a collecting device that collects powder particles (such as semolina) falling through sieves is provided below the sieve box, and an air distribution chamber is further provided above the sieve box, the air distribution chamber sucking air passing from a lower portion to an upper portion of the sieves. In the purifier, the air distribution chamber is configured of paired inclined surfaces formed as being tapered upward and has a suction passage formed as a horizontal cyclone placed above the air distribution chamber, a plurality of barrier walls are provided in the air distribution chamber in a direction perpendicular to a longitudinal direction of the sieve layers, the air distribution chamber is sectioned by the barrier walls into a plurality of chambers, and rectifying plates are further provided to the air distribution chamber at a narrow position between the paired inclined surfaces to prevent non-uniformity of suction of powder on the sieve layers.

Another technical means is provided such that the sieve box is configured to have a rear end face with an opening formed for each layer, the opening from which the sieves can be inserted and removed, the sieve box holds the sieves for each layer in guide rails formed along the longitudinal direction in the sieve box, and sieve fixing means is further provided to the opening, the sieve fixing means closing the opening as pressing a sieve on a lowermost downstream side among the sieves, and the sieve fixing means includes a main body that presses a rear end of the sieve on the lowermost downstream side, a lid member that closes the opening, paired knob bolts that screw between the lid member and the main body so as to be able to adjust a space therebetween to be widened and narrowed, and an elastic member inserted in a screw fit-in portion between the lid member and the main body, and the lid member is further provided with paired closing means capable of closing or releasing the opening with a manual operation.

Still another technical means is provided such that, in the purifier, an anti-roll member is inserted in each of the legs supporting the sieve box, the anti-roll member preventing shake in a short-side direction forming a right angle with respect to the longitudinal direction of the sieve box.

DETAILED DESCRIPTION

With reference to the drawings, best mode for carrying out the invention is described.

General Outline

In FIGS. 1 to 4, a purifier 1 according to the present invention has a duplex structure. The duplex-structured purifier 1 has sieve boxes 10 in two rows to process two types of stock. The sieve boxes 10 in two rows are separately disposed to left and right with respect to a center machine casing 17.

Figure 1:
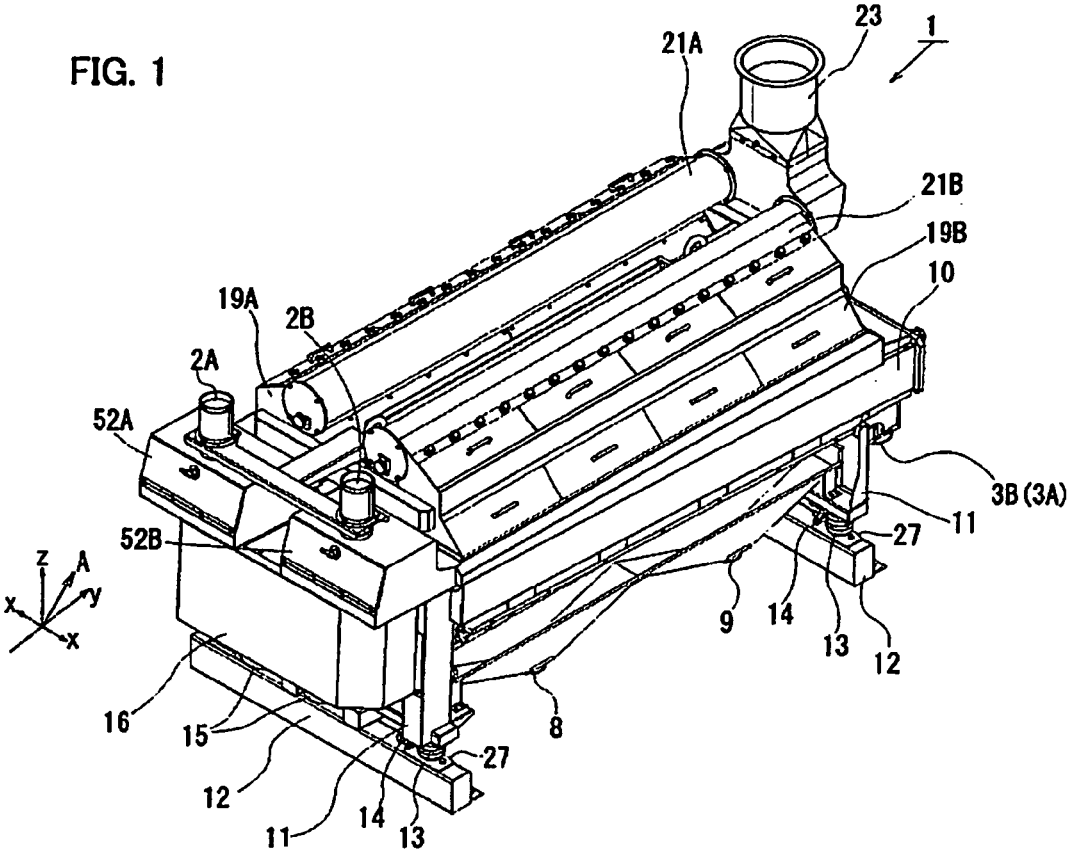
FIG. 1 is a schematic perspective view of a purifier according to an embodiment of the present invention.
Figure 2:
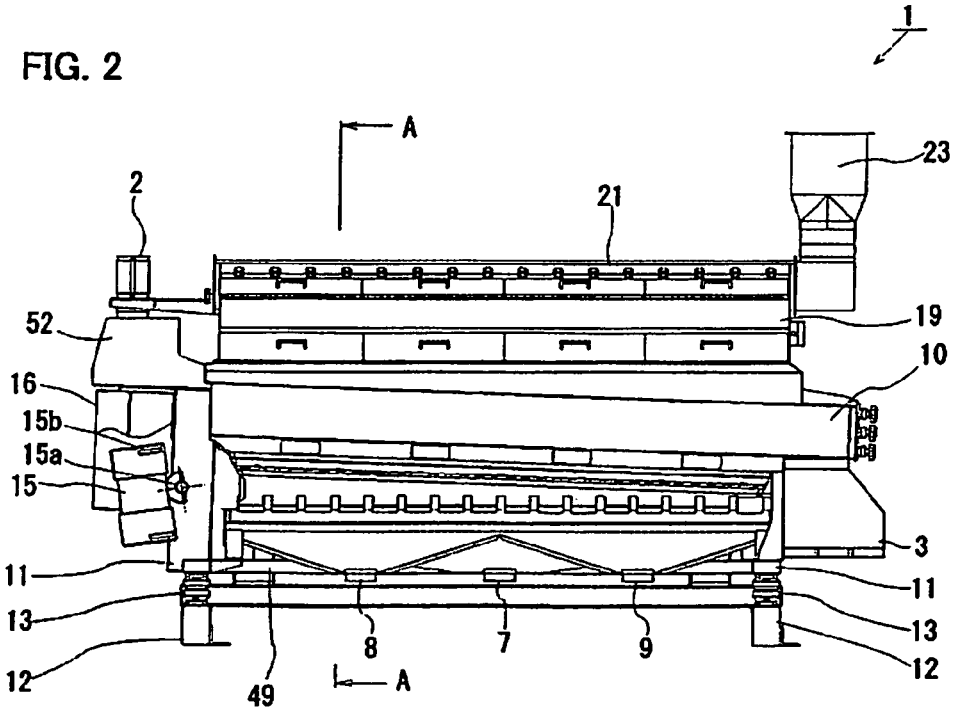
FIG. 2 is a partially-broken front view of the purifier.

As depicted in FIGS. 1 and 2, a supply inlet 2 is provided on an upper-left portion of the purifier 1, that is, on an upstream side of the sieve boxes 10. To the supply inlet 2, powder particles as a material before classification and purification are supplied. A separated-substance discharge outlet 3 is provided on a lower-right portion of the purifier 1, that is, on a downstream side of the sieve boxes 10. The discharge outlet 3 is to discharge a separated substance (overtail) that cannot pass through the sieve mesh. In each sieve box 10, a plurality of sieves 4 stacked in three stages are mounted. These sieves 4 are disposed in a longitudinal direction of the sieve boxes 10, that is, in increasing order of scale spacing from the upstream side to the downstream side. Below these sieves 4, an inner trough 5 and an outer trough 6 serving as devices collecting powder particles are disposed (refer to FIG. 4). Powder particles sifted through the sieves 4 are collected in these inner trough 5 and outer trough 6. The inner trough 5 communicates with a center falling outlet 7, from which the powder particles passing through the sieves 4 are taken out of the purifier 1. The outer trough 6 communicates with an upstream-side falling outlet 8 for powder particles passing through a plurality of sieves 4 with large mesh and a downstream falling outlet 9 for powder particles passing through a plurality of sieves 4 with fine mesh. From these falling outlets 8 and 9, powder particles of varying particle size can be taken out of the purifier 1. A reference numeral 50 (FIG. 4) denotes a product guiding flap. A reference numeral 51 (FIG. 4) denotes an air intake hole. A reference numeral 52 (FIG. 2) denotes a material supply feeder.

Vibration Structure

Each of the above-described sieves 4 is accommodated in the sieve box 10. The sieve box 10 is supported by at least four legs 11 onto a support base 12. Between a bottom portion 24 at a lower end of each leg 11 and a bottom portion 27 of the support base 12, a plurality of hollow rubber springs 13 and a plurality of anti-roll members 14 are disposed and mounted. Thus, by removing the bottom portions 24 and 27, the hollow rubber springs 13, which are consumable items, can be easily taken out of the purifier 1. Therefore, the purifier 1 can be easily maintained, and the time required for exchanging the hollow rubber springs 13 can be reduced. Also, for example, a cross beam 49 that connects the legs 11 together in a rectangular shape is set up, and two unbalanced vibration generating devices 15 are mounted on a supply inlet 2 side of the legs 11 and the cross beam 49. The unbalance vibration generating devices 15 provide linear vibrations in a predetermined direction indicated by an arrow A (FIG. 1) to the cross beam 49.

The anti-roll members 14 allow motions in a longitudinal direction (a direction indicated by an arrow y in FIG. 1) and a vertical direction (a direction indicated by an arrow z in FIG. 1), and regulate motions in a lateral direction (a direction indicated by arrows x in FIG. 1). With the function of regulating motions in the lateral direction, the purifier 1 is directed in the linear vibrating direction indicated by the arrow A in FIG. 1 as described above when the direction of vibration by the unbalanced vibration generating device 15 is unstable, for example, at the time of starting and stopping the operation of the purifier 1. As a result, the unbalanced vibration generating device 15 can be effectively prevented from providing rolling in the lateral direction to the sieve boxes 10.

The mount angle of each unbalanced vibration generating device 15 (FIG. 2) can be adjusted by rotation with a pipe-shaped joint 15*a*. Also, the degree (strength) of unbalance can be increased and decreased by appropriately adjusting an unbalance spindle 15*b*. To the pipe-shaped joint 15*a*, two unbalanced vibration generating devices 15 are fixed to be electrically connected so as to vibrate in reversed directions, thereby removing an unbalance component sideward and producing linear vibrations straight toward the direction indicated by the arrow A in FIG. 1. A reference numeral 16 denotes a cover body of the unbalance vibration generating devices.

Non-Vibration Components

The non-vibration components are mounted on the machine casing 17 (FIGS. 3 and 4) on the support base 12. The machine casing 17 has an upper end formed in an approximately T shape so as to be placed across the right and left sieve boxes 10. This machine casing 17 supports a support base head 19. The support base head 19 is a part of the non-vibration components to form an air distribution chamber 18. The air distribution chamber 18 is to raise air mixed with powder passing through the plurality of sieves 4 and suck the air. This air is obtained after passing through from a lower portion to an upper portion of the sieves 4 and being screened. Inside of the air distribution chamber 18, a plurality of barrier walls 53' (FIG. 6) are provided in a direction perpendicular to a longitudinal direction of the plurality of sieves 4. The inside of the air distribution chamber 18 is sectioned into a plurality of chambers by the barrier walls 53'. As for left and right air distribution chambers 18A and 18B, an upper portion of the air distribution chamber 18A (18B) is formed with a pair of inclined surfaces 18*a* (18*b*) facing each other, and a rectifying plate 20 is provided at a narrow portion between the paired inclined surfaces 18. The rectifying plate 20 is to prevent non-uniformity of powder absorption on the plurality of sieves 4. Above the rectifying plate 20, a cyclone-type suction portion 21 is connected. The suction portion 21 forms a swirl of air collected by the paired inclined surfaces 18 facing each other in an inverse hopper shape. The suction portion 21 is connected to a suction exhaust machine not shown via a suction exhaust tube 23. A reference numeral 22 denotes an open/close valve for adjusting the amount of air suction.

Structure of Rectifying Plate in Air Distribution Chamber

Figure 5:
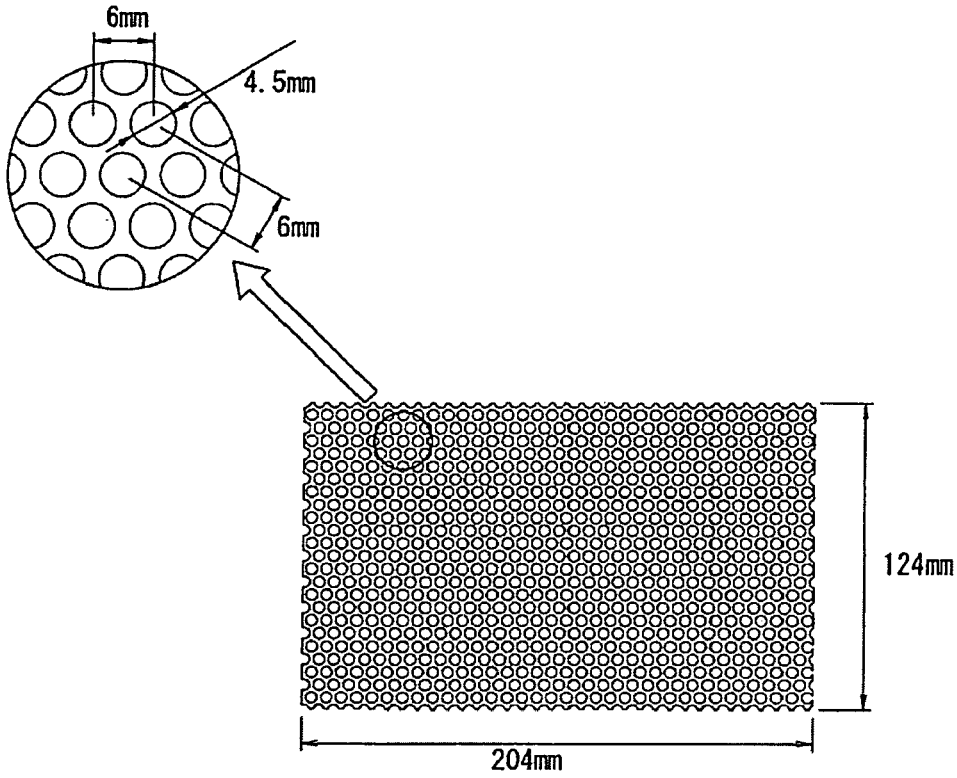
FIG. 5 is a schematic view of a rectifying plate disposed on an upper portion of an air distribution chamber.

FIG. 5 depicts the rectifying plate 20 disposed above the air distribution chamber 18. This rectifying plate 20 is a rectangular iron plate of 124 mm in height 204 mm in width, and 1.6 mm in thickness, and the iron plate is punched with many holes to form a perforated metal. The diameter of each hole is preferably in a range of 4.5 mm to 8.0 mm. More preferably, the diameter of each hole is 4.5 mm and the aperture ratio is in a range of approximately 51% to 45%. With these dimensional ranges of the diameter of each hole and the aperture ratio, the suction force over the sieves 4 in a width direction becomes more uniform. Therefore, the powder can be uniformly sucked, and non-uniformity of suction can be prevented.

Figure 4:
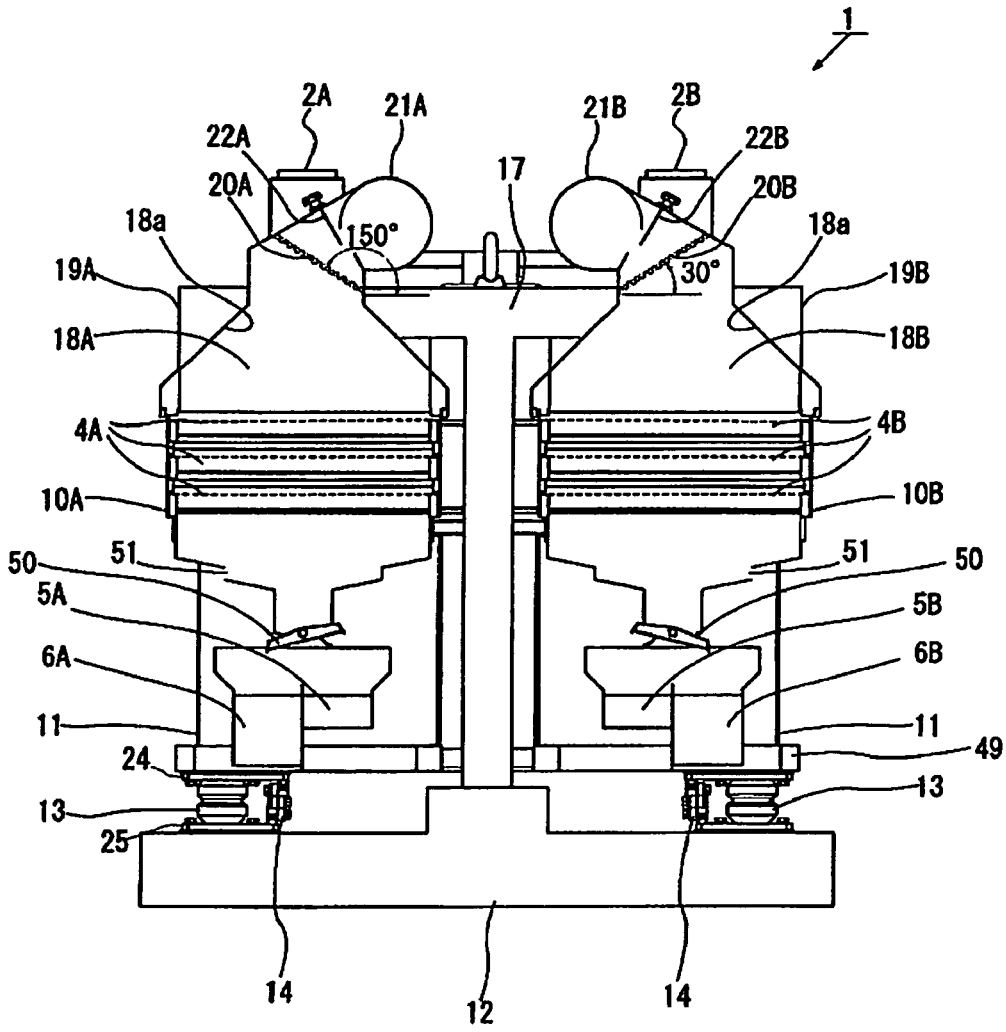
FIG. 4 is a longitudinal section view along an A-A line in FIG. 2.

How to mount the rectifying plate 20 is described with reference to FIGS. 4 and 6. As depicted in FIG. 4, each rectifying plate 20 is provided at a narrow portion between the paired inclined surfaces 18 so that a rectifying surface is inclined toward a direction of placing the horizontal cyclone.

Figure 6:
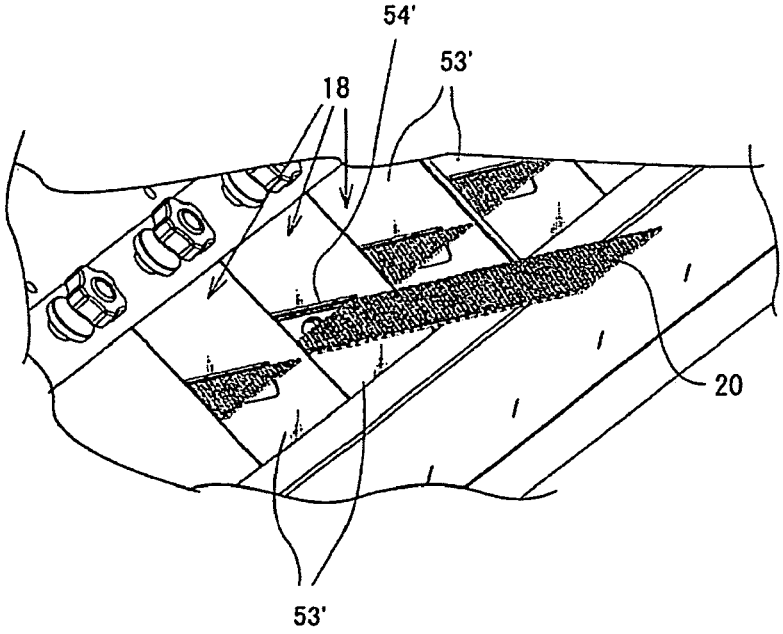
FIG. 6 is a schematic perspective view when the rectifying plate is mounted on the air distribution chamber.

As depicted in FIG. 6, the plurality of rectifying plates 20 are insertably held by guide rails 54' mounted on the barrier walls 53'. As depicted in FIG. 4, the guide rails 54' are mounted at 30 degrees with respect to a horizontal direction on a side of holding a rectifying plate 20B and at 150 degree with respect to a horizontal direction on a side of holding a rectifying plate 20A. As such, with the rectifying plates 20 being mounted so as to be inclined at a position at 150 degrees with respect to the horizontal direction, powder deposition over upper surfaces of the rectifying plates 20 can be eliminated, thereby reducing load of maintenance after activation of the purifier 1. If the rectifying plates 20 are mounted in the horizontal direction, powder is deposited on the upper surfaces of the rectifying plates, thereby requiring maintenance, such as cleaning after activation.

Operation

When two unbalanced vibration generating devices 15 are activated to start the purifier 1, the sieve boxes 10, the inner troughs 5, and the outer troughs 6 vibrate. At the time of this start, the anti-roll preventing members 14 regulates motions in the lateral direction (the direction indicated by the arrow x in FIG. 1) for orientation to the original linear vibrating direction (the direction indicated by the arrow A in FIG. 1), thereby preventing the occurrence of roll of the sieve boxes 10 in the lateral direction. Also, the suction exhaust machine (not shown) communicating with the suction exhaust tube 23 is activated to suck air from the air intake hole 51. With this, an updraft occurs from the lower portion to the upper portion of the sieves 4 in the sieve boxes 10. The rectifying plate 20 provided above each air distribution chamber 18 rectifies air suction to the air intake hole 51, thereby uniformly sucking powder.

The powder particles before classification and purification are supplied from the supply inlet 2 to the material supply feeder 52. At the material supply feeder 52, the powder particles are supplied onto the sieves 4 after being rectified to be widespread. The powder particles on the sieves 4 mounted to be slightly longitudinally inclined flow to the downstream side by the vibration in the longitudinal direction (the A direction in FIG. 1). With the powder particles being shaken on the sieves 4, heavy particles go downward and light particles go upward. Then, with the updraft passing from the lower portion to the upper portion of the sieves 4, light skin portions go upward, and the heavy particles are left as they are. Semolina particles pass through the mesh of the sieves 4 to fall down to sieve layers 4*b* and 4*c* at lower stages. As described above, the updraft is rectified in a width direction of the sieves 4. Since the sieves 4 are sequentially arranged from the upstream side to the downstream side so that the mesh is larger, semolina particles falling down from the sieves 4 on the upstream side have a fine particle size, while semolina particles falling down from the sieves 4 on the downstream side have a large particle size. Overtail including skin portions not falling down from the sieves 4 ends up in being guided to the separated-substance discharge outlet 3.

The semolina particles falling down from the sieves 4 are collected by the inner trough 5 and the outer trough 6 for classification. That is, in this structure, screened semolina particles are collected to the inner trough 5 and the outer trough 6 and, furthermore, the inner trough 5 communicates with the center falling outlet 7 to have the semolina particles passing through the sieves 4 taken out of the purifier 1. The outer trough 6 communicates with the upstream falling outlet 8 for particles passing through sieves with a large wire gauge and the downstream falling outlet 9 for particles passing through sieves with a fine wire gauge. Through these outlets, semolina particle of varying particle size are taken out of the purifier 1.

As described above, according to the present embodiment, the rectifying plates for preventing non-uniformity of suction of powder on the sieves 4 are disposed above the air distribution chambers 18. Therefore, the suction force in the width direction on the sieves 4 is uniform, and the powder is uniformly sucked. Thus, non-uniformity of suction can be prevented. Also, each rectifying plate is formed to be a perforated metal, and its hole diameter is in the range of 4.5 mm to 8.0 mm, and the aperture ratio is in the range of 51% to 45%. With this, the effect of making the suction force in the width direction on the sieves 4 is significantly improved compared with the conventional technology, and the effect of uniformly sucking powder to prevent non-uniformity of suction is enhanced.

Furthermore, regarding the direction of mounting each rectifying plate 20, as depicted in FIG. 4, the rectifying plate 20B is disposed as being inclined at 30 degrees with respect to the horizontal direction, and the rectifying plate 20A is disposed as being inclined at 150 degrees with respect to the horizontal direction. Therefore, powder is less prone to being deposited on the upper surface of the rectifying plate 20, and load of maintenance after activation can be reduced.

Structure of Inside of Sieve Box

Figure 7:
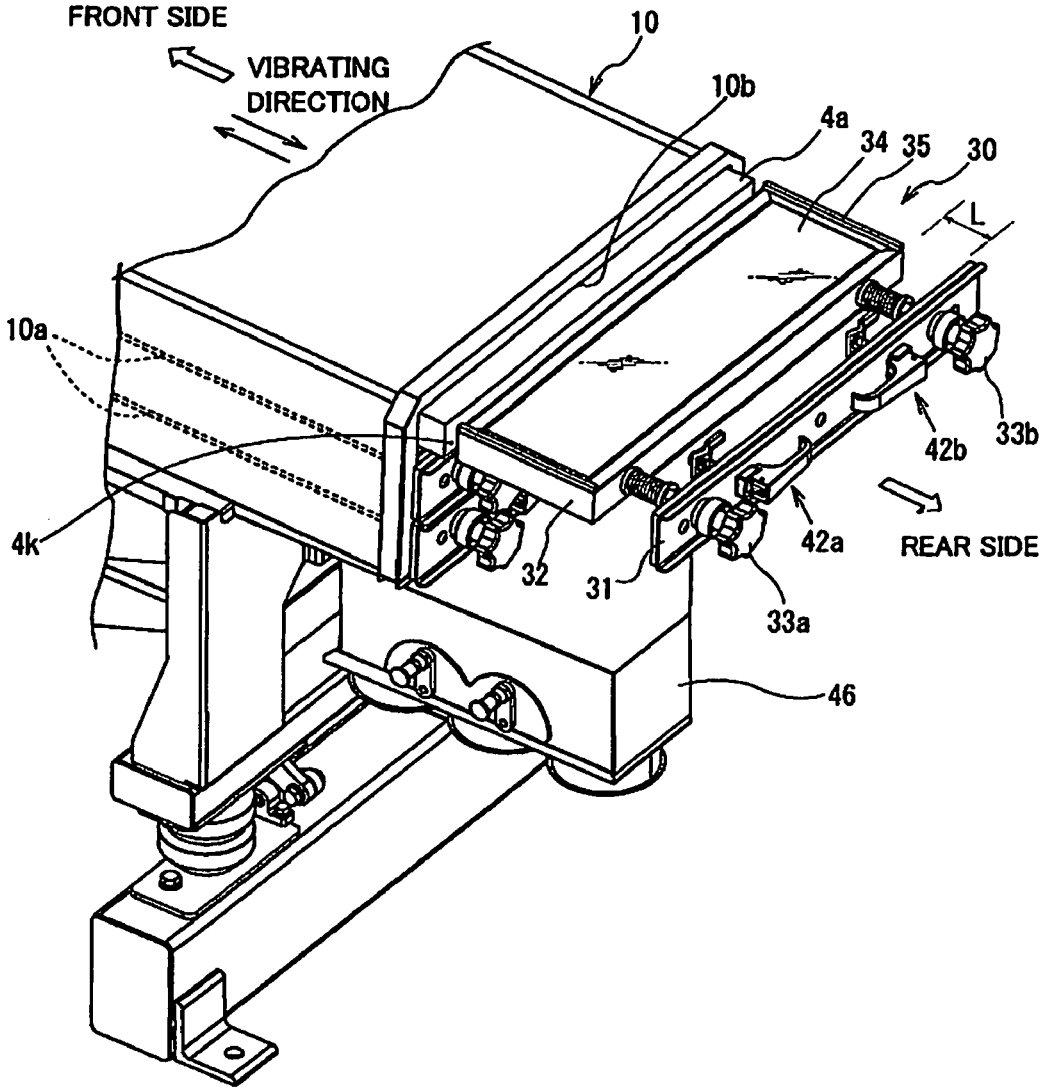
FIG. 7 is a perspective view of a component structure when sieves are accommodated in a sieve box of the purifier according to the embodiment of the present invention.

As depicted in FIG. 7, each layer of the sieves 4 accommodated in each sieve box 10 is held by guide rails 10*a* provided in the sieve box 10. The guide rails 10*a* are provided on both sides of the sieve box 10 along the longitudinal direction of the sieve box 10. Each layer of the sieves 4 has both end edges in a short-side direction held between the guide rails 10*a*. An opening 10*b* is formed for each layer of the sieves 4 on the rear end face of the sieve box 10. Each layer of the sieves 4 can be inserted or removed along the guide rails 10*a* from the rear end face side of the sieve box 10.

Structure of Sieve Fixing Means

Figure 8:
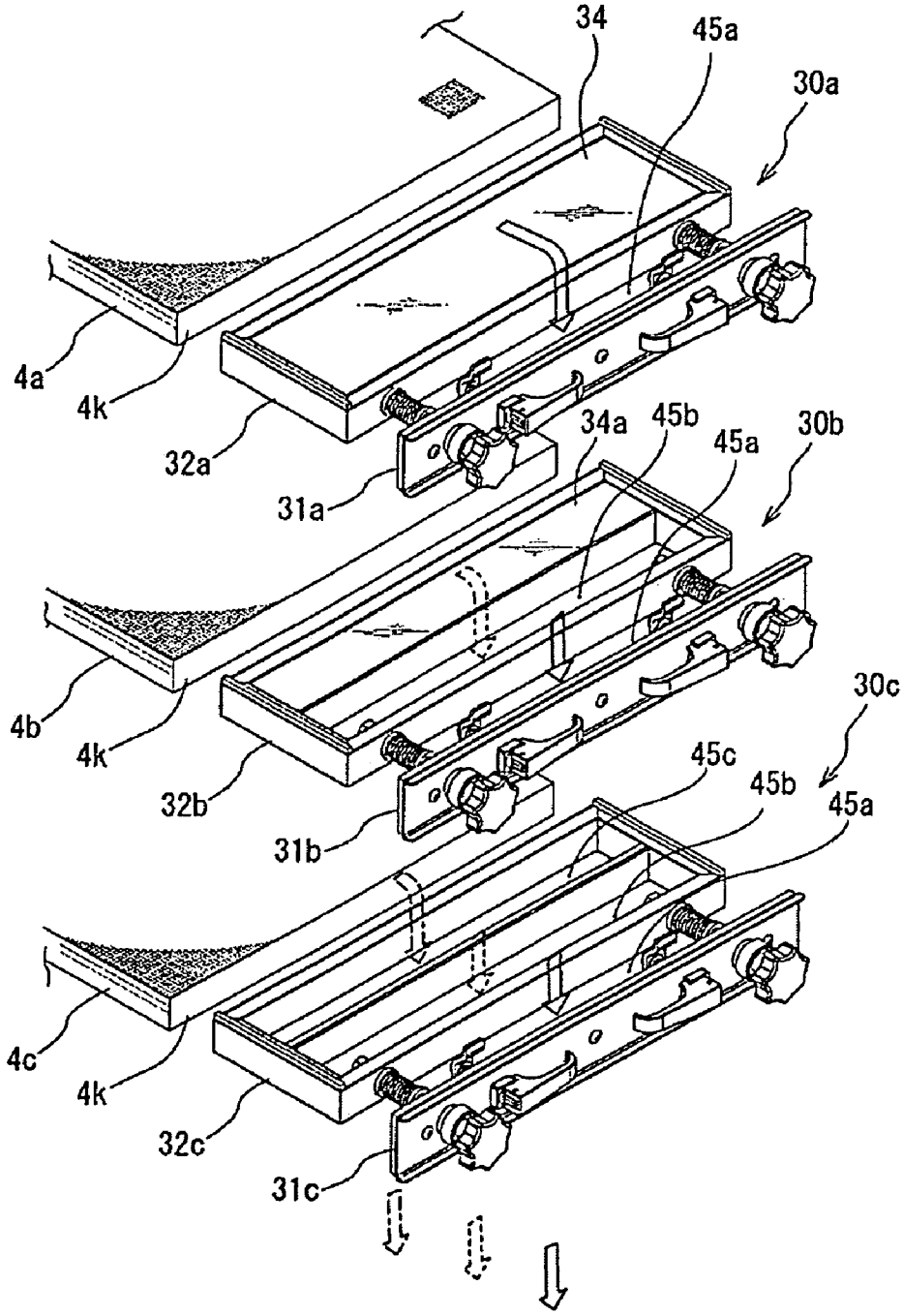
FIG. 8 is a perspective view of overtail discharge outlets formed on sieve fixing means of a sieve layer for each stage.
Figure 10:
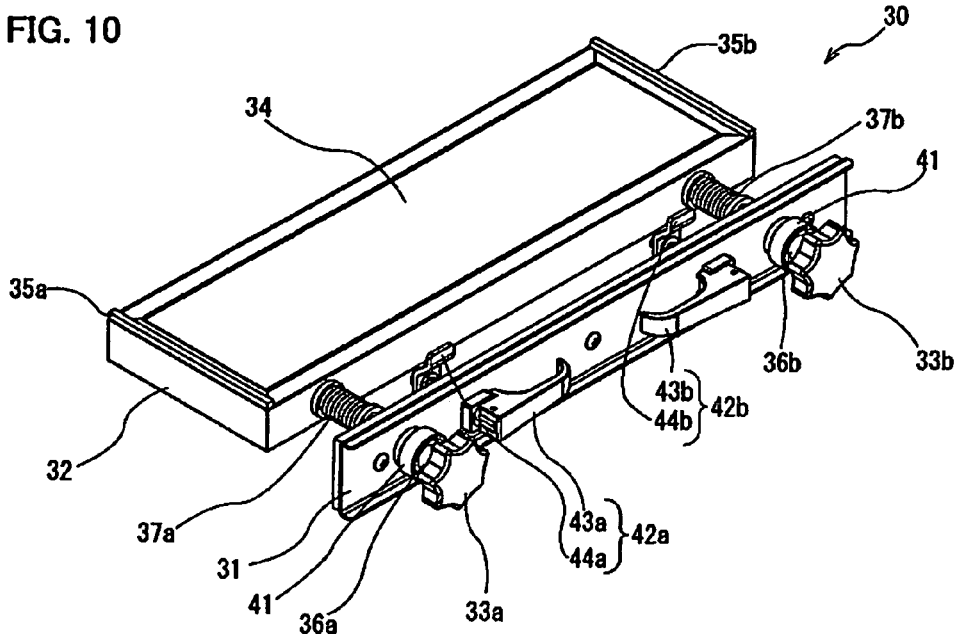
FIG. 10 is a perspective view of a component structure of the sieve fixing means.
Figure 11:
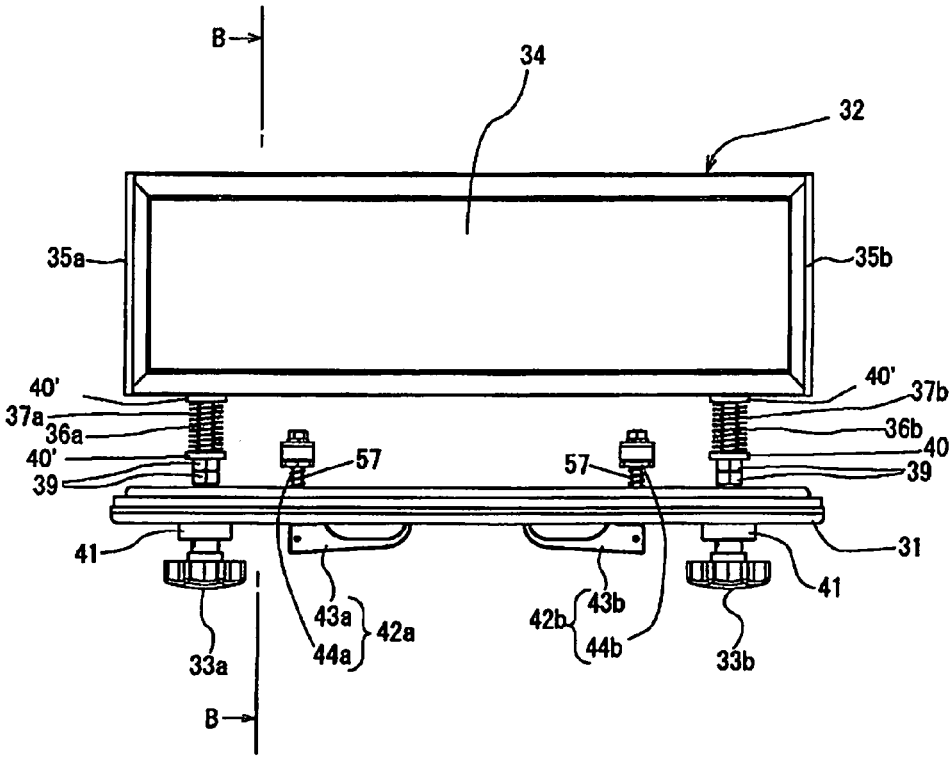
FIG. 11 is a plan view of the sieve fixing means.
Figure 12:
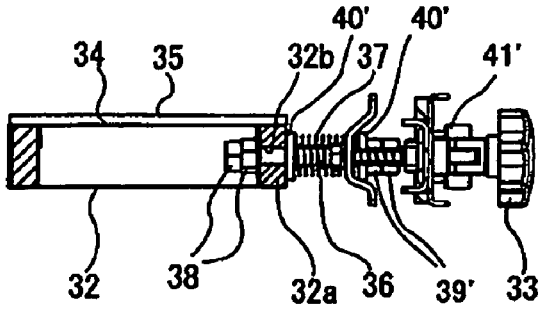
FIG. 12 is a section view along a B-B line in FIG. 11.

As depicted in FIGS. 7 and 8, a rear, end 4*k* of each layer of the sieves 4 is pressed by a relevant one of a plurality of sieve fixing means 30, and is fixed by closing the opening 10*b* of the sieve box 10 with a lid member 31 of the sieve fixing means 30. The sieve fixing member 30 is configured so that the clamping force in a depth direction of the layer of the sieves 4 can be adjusted. That is, as depicted in FIGS. 10, 11, and 12, the sieve fixing means 30 mainly include a lid member 31 that closes the opening 10*b* of the rear end face of the sieve box 10, a main body 32, and paired knob bolts 33*a* and 33*b* coupling the main body 32 and the lid member 31. A stainless plate 34 and seals 35*a* and 35*b* for preventing a leak of powder from the opening 10*b* are affixed to the main body 32; the stainless plate is shaped with a rectangular shape so as to press the rear end 4*k* of the sieve 4 and has a smooth surface for conveying overtail to the upper surface.

The lid member 31 is threaded with paired screw holes in which the knob bolts 33*a* and 33*b* are screwed. In these screw holes, the knob bolts 33*a* and 33*b* are screwed toward the main body 32. Here, coil springs 37*a* and 37*b* are attached as elastic members to bolt portions 36*a* and 36*b* of the knob bolts 33*a* and 33*b*, respectively, between the lid member 31 and the main body 32. After being inserted in a mount hole 32*b*' provided by piercing a frame portion 32*a*' of the main body 32, each of the knob bolts 33*a* and 33*b* is fixed to the main body 32 with a double nut 38 (refer to FIG. 12). With this, the main body 32 and the lid member 31 can be coupled, with the elastic force being kept by the knob bolts 33*a* and 33*b* and the coil springs 37*a* and 37*b*. Here, in FIGS. 10, 11, and 12, a reference numeral 39' denotes a double nut for fixing the coil springs 37*a* and 37*b*, a reference numeral 40' denotes a washer, and a reference numeral 41 denotes a stopper that fixes the knob bolts 33*a* and 33*b*.

Operation of Sieve Fixing Means

By rotating the knob bolts 33*a* and 33*b*, the space between the main body 32 and the lid member 31 can be adjusted to be widened and narrowed. When the space is widened, the main body 32 extends in a front side direction to adjust a pressing force onto the sieves 4 upward in a dept direction. When the space is narrowed, the main body 32 is retracted in a rear side direction to adjust the pressing force onto the sieves 4 downward in the dept direction.

Closing Means

On the lid member 31, closing means 42*a* and 42*b* are mounted that allow a manual operation of opening and closing the opening 10*b* of the sieve box 10 and the lid member 31. In these closing means 42*a* and 42*b*, when paired handles 43*a* and 43*b* are pulled up, latches 44*a* and 44*b* are retracted to weaken the pressing force by springs 57 between the latches 44*a* and 44*b* and the edge of the opening 10*b*. Furthermore, by rotating the handles 43*a* and 43*b*, the engagement between the latches 44*a* and 44*b* and the edge of the opening 10*b* is released to allow an opening and closing operation. As the closing means 42*a* and 42*b*, commercially available product can be used, such as type THA-164 manufactured by Tochigiya Co., Ltd.

Overtail Discharge Outlets

On the other hand, in the sieve fixing means 30 pressing each layer of the sieves 4 at each stage, a plurality of discharge outlets 45 are formed that guide overtail from each sieve 4 at each stage to the separated-substance discharge outlet 3. That is, as depicted in FIG. 8, in sieve fixing means 30*a* at an upper stage (a first stage), one discharge outlet 45*a* is formed in a space between a main body 32*a* and a lid member 31*a*. In sieve fixing means 30*b* at a middle stage (a second stage), in addition to the discharge outlet 45*a* described as above, a discharge outlet 45*b* corresponding to a space provided by cutting a rear-half portion of the stainless plate 34 at the upper stage is also provided, and therefore two discharge outlets 45*a* and 45*b* are formed. Furthermore, in sieve fixing means 30*c* at a lower stage (a third stage), in addition to the discharge outlets 45*a* and 45*b* described as above, a discharge outlet 45*c* corresponding to a space provided by cutting a stainless plate 34*a* at the middle stage is also provided, and therefore three discharge outlets 45*a*, 45*b*, and 45*c* are formed.

With the above structure, as indicated by solid-line arrows in FIG. 8, overtail from a sieve layer 4*a* at the upper stage (the first stage) goes to the stainless plate 34 on the upper surface of the main body 32*a* of the sieve fixing member 30*a*, and then passes through three discharge outlets 45*a* formed from the upper stage to the lower stage to be guided to the separated-substance discharge outlet 3. As indicated by broken-line arrows in FIG. 8, overtail from a sieve layer 4*b* at the middle stage (the second stage) goes to the stainless plate 34*a* on the upper surface of the main body 32*b* of the sieve fixing member 30*b*, and then passes through two discharge outlets 45*b* formed from the middle stage to the lower stage to be guided to the separated-substance discharge outlet 3. As indicated by a one-dot-chain arrow in FIG. 8, overtail from a sieve layer 4*c* at the lower stage (the third stage) passes through the discharge outlet 45*c* formed in the sieve fixing means 30*c* to be guided to the separated-substance discharge outlet 3. That is, the discharge outlets 45*a*, 45*b*, and 45*c* have a separating function of guiding overtail for each of the sieve layers 4*a*, 4*b*, and 4*c* of each layer.

Separated-Substance Discharging Unit

Figure 9:
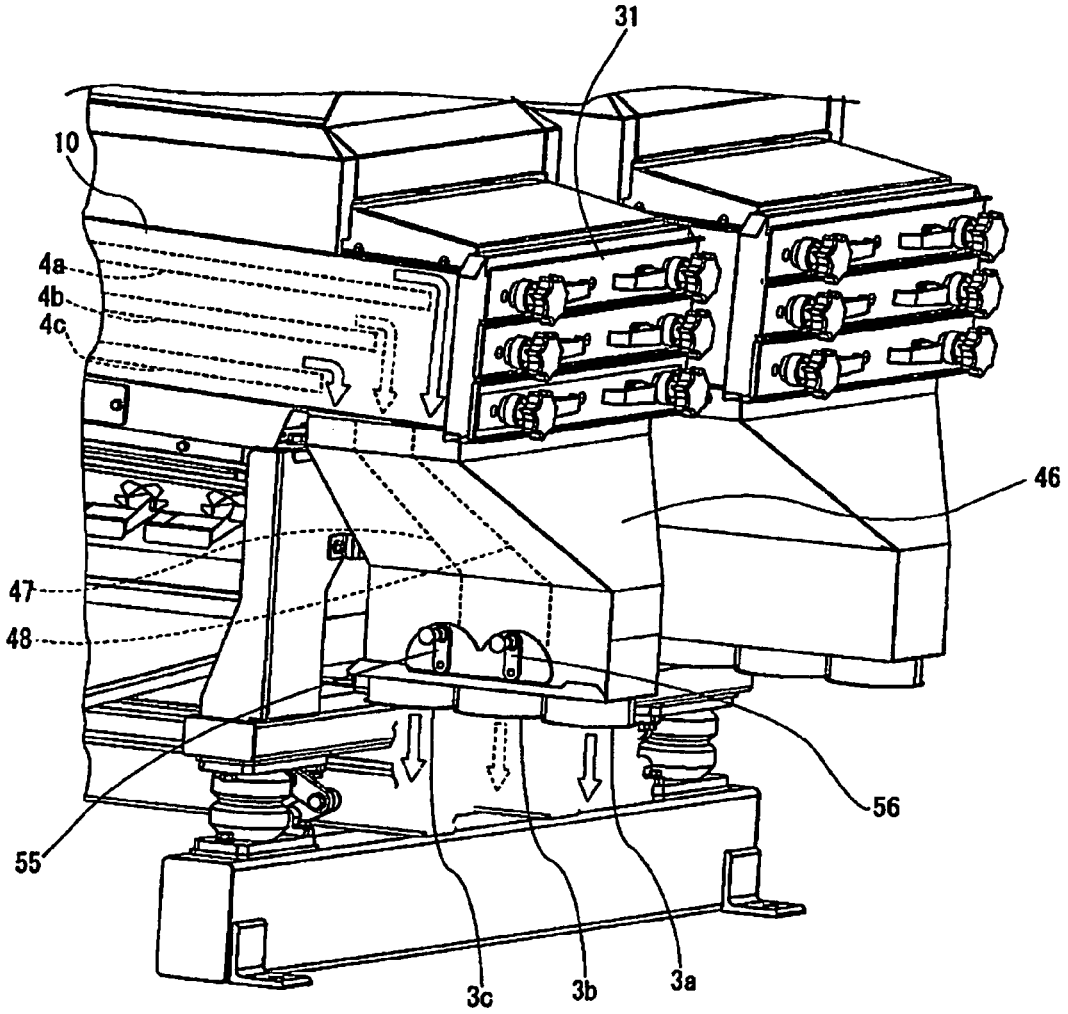
FIG. 9 is a perspective view of a rear portion of sieve boxes and separated-substance discharge gutters.
Figure 13:
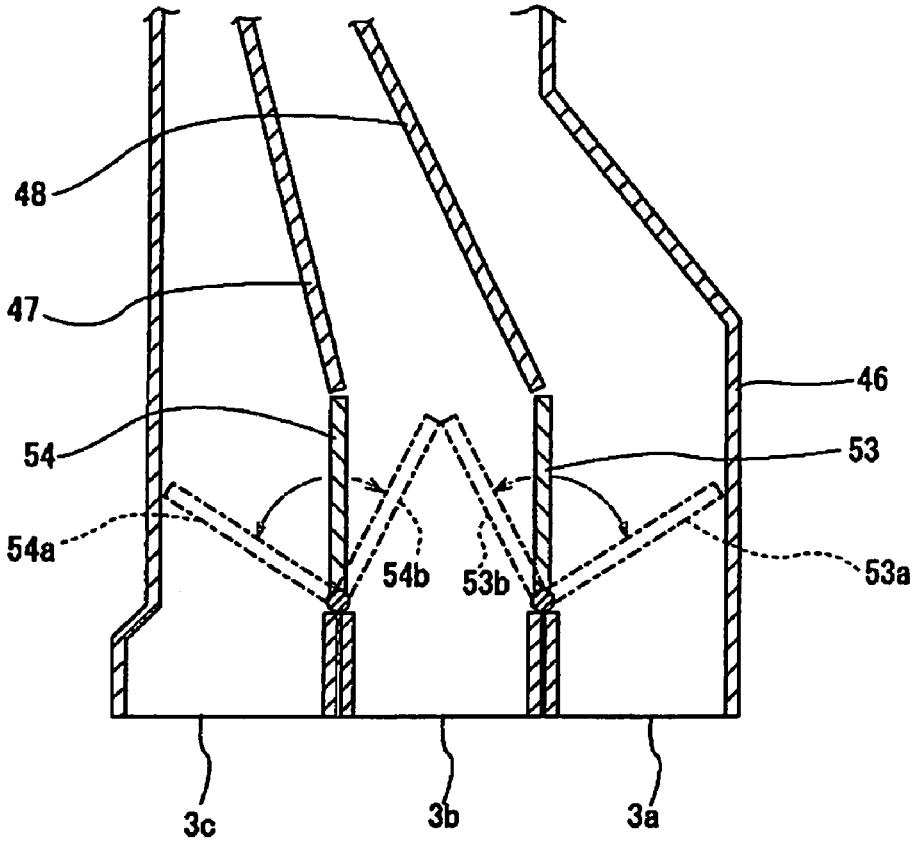
FIG. 13 is a schematic section view illustrating a switching direction of a branch bulb disposed in the separated-substance discharge gutter.
Figure 14:
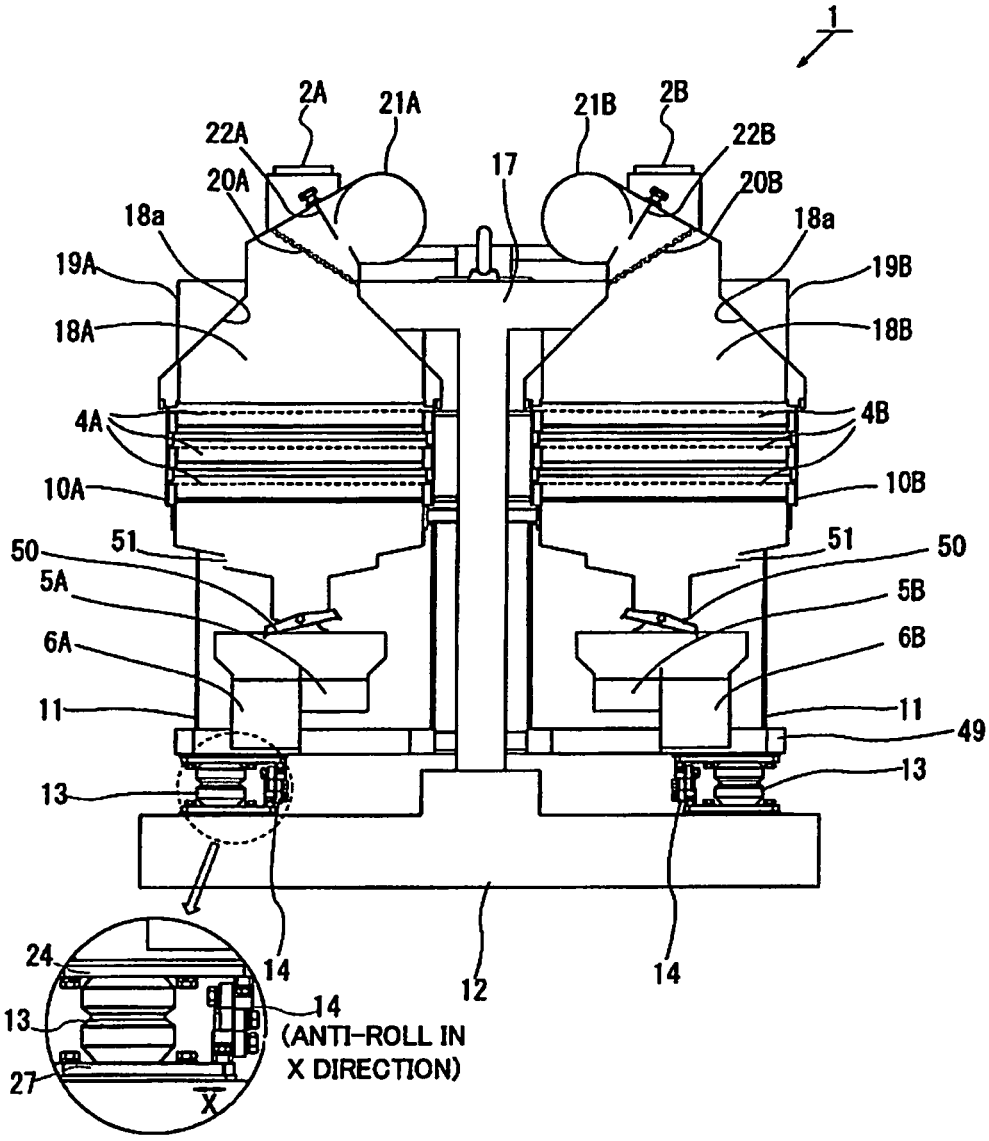
FIG. 14 is a longitudinal section view along the A-A line in FIG. 2.

As depicted in FIG. 9, on the downstream side of the sieve box 10, a separated-substance discharge gutter 46 is mounted that guides overtail flowing down from the sieve box 10 to the separated-substance discharge outlet 3. In the separated-substance discharge gutter 46, barrier walls 47 and 48 are disposed a predetermined space apart from each other. Further below the barrier walls 47 and 48, switching knobs 55 and 56 for operating branch valves 53 and 54 (FIG. 13). With this, when the branch valves 53 and 54 are set at neutral positions (branch valves 53 and 54 depicted as solid lines in FIG. 13), overtail can be discharged in a separate manner such that overtail from the sieve layer 4*a* at the upper stage (the first stage) is discharged to a separated-substance discharge outlet 3*a*, overtail from the sieve layer 4*b* at the middle stage (the second stage) is discharged to a separated-substance discharge outlet 3*b*, and overtail from the sieve layer 4*c* at the lower stage (the third stage) is discharged to a separated-substance discharge outlet 3*c*.

Here, as depicted in FIG. 13, when the branch valves 53 and 54 are switched as indicated by reference numerals 53*a* and 54*a* to be set so as to close the separated-substance discharge outlets 3*a* and 3*c*, all overtail from the sieve layer 4*a* at the upper stage (the first stage), the sieve layer 4*b* at the middle stage (the second stage), and the sieve layer 4*c* at the upper stage (the third stage) can be aggregated and discharged from the separated-substance discharge outlet 3*b*. Also, when the branch valves 53 and 54 are switched as indicated by reference numerals 53*b* and 54*b* to be set so as to close the separated-substance discharge outlet 3*b*, overtail can be discharged as being branched into two directions, that is, to the separated-substance discharge outlets 3*a* and 3*c*.

That is, since different flour mills use different types, numbers, and specifications of machines for use in respective processes from break to reduction, switching of the branch valves 53 and 54 can be set according to a process chart for flour milling at each flour mill.

Operation

The operation in the above structure is described. First, as a preparing stage, as depicted in FIGS. 7 and 8, four sieves 4 of different meshes are incorporated along the guide rails 10*a* (refer to FIG. 7) at each stage of the sieve box 10. Sieves are inserted into the sieve box 10 sequentially from the sieve having the finest mesh. The first sieve for use has a sieve mesh coarser than a sieve mesh with which a stock is left in a sifter at the previous stage, and the fourth sieve for use has a sieve mesh coarser than a sieve mesh which the stock passes through in the previous sifter or a sieve mesh with at least the same wire gauge.

In the purifier 1 as in the present embodiment including the upper stage (the first stage), the middle stage (the second stage), and the lower stage (the third stage), preferably for example, four sieves with wire gauge numbers of 24, 22, 20, and 18 are incorporated as the sieve layer 4*a* at the upper stage (the first stage), four sieves with wire gauge numbers of 26, 24, 22, and 18 are incorporated as the sieve layer 4*b* at the middle stage (the second stage), and four sieves with wire gauge numbers of 32, 28, 26, and 22 are incorporated as the sieve layer 4*c* at the lower stage (the third stage).

After the plurality of sieves 4 are incorporated in the sieve box 10 as described above, as depicted in FIGS. 7 and 8, the sieve fixing means 30 is pressed onto the rear end 4*k* of the sieve 4 positioned on a lowermost downstream side of each layer of the sieves 4. Then, the opening 10*b* of the sieve box 10 is closed with the lid member 31 for fixing. This operation is achieved by pulling up the handles 43*a* and 43*b* mounted on the lid member 31 and grabbing them by hands for rotation. The latches 44*a* and 44*b* are then engaged into the edge of the opening 10*b*. Furthermore, when the handles 43*a* and 43*b* are pushed down, the latches 44*a* and 44*b* are pressed and fixed by the springs 57 onto the edge of the opening 10*b*.

Next, when the stoppers 41 are loosened to adjust the knob bolts 33*a* and 33*b* mounted on the lid member 31, a space L between the main body 32 and the lid member 31 of the sieve fixing means 30 can be adjusted to be widened and narrowed. That is, when the space L between the main body 32 and the lid member 31 is widened, the main body 32 extends in the front side direction of the sieve box 10 to adjust the pressing force onto the sieves 4 in the depth direction to be a strong force, thereby making the space substantially zero and achieving sufficient pressing. With this, appropriate close pressing can be attained among the sieves 4 to eliminate "rattle". Even under violent vibrations at the time of screening, the sealing function sufficiently works to prevent a leak of powder. "Rattle" is caused due to the occurrence a slight space between four sieves 4 of varying wire gauge incorporated at each stage.

On the other hand, when the pressing force is desired to be weakened because the sieves 4 currently incorporated are different from the previous sieves 4 owing to an exchange of the sieves 4, the space between the main body 32 and the lid member 31 is narrowed to cause the main body 32 to be retracted in the rear side direction, thereby adjusting the pressing force onto the sieves 4 in the depth direction to be a weak force. After this adjustment ends, the stoppers 41 are screwed to fix the knob bolts 33*a* and 33*b*.

When the purifier 1 is activated, overtail including a skin portion not falling through the sieves 4 reaches the discharge outlets 45 of the sieve fixing means 30 that presses the sieves 4 at each stage.

As described above, when the sieves 4 in the sieve box 10 are removed, the handles 43*a* and 43*b* of the closing means 42*a* and 42*b* mounted on the lid member 31 are pulled up and grabbed by hands for rotation. With this, the engagement between the latches 44*a* and 44*b* and the edge of the opening 10*b* can be released, and the lid member 31 can be removed from the opening 10*b*. Next, the sieves 4 are withdrawn along the guide rails 10*a* of the sieve box 10. Thus, the sieves 4 can be removed from the sieve box 10.

On the other hand, when the sieves 4 are attached into the sieve box 10, after the plurality of sieves 4 are incorporated in the sieve box 10, the main body 32 is pressed onto the rear end 4*k* of each layer of the sieves 4, and then the handles 43*a* and 43*b* of the closing means 42*a* and 42*b* mounted on the lid member 31 are pulled up. Then, the handles 43*a* and 43*b* are rotated to engage the latches 44*a* and 44*b* into the edge of the opening 10*b*. Finally, when the handles 43*a* and 43*b* are pulled down, the latches 44*a* and 44*b* are pressed and fixed by the springs 57 onto the edge of the opening 10*b*. With this, the sieves 4 can be easily and rapidly attached to and removed from the sieve box 10.

Next, the knob bolts 33*a* and 33*b* mounted on the lid member 31 are adjusted through rotation to adjust the space L between the main body 32 and the lid member 31 of the sieve fixing means 30 to be a wide space. That is, the main body 32 extends in the front side direction of the sieve box 10 to adjust the pressing force onto the sieves 4 in the dept direction to be a strong force, thereby making the space between the sieves 4 substantially zero and achieving sufficient pressing. With this, appropriate close pressing can be attained among the sieves 4 to eliminate "rattle". Even under violent vibrations at the time of screening, the sealing function sufficiently works to prevent a leak of powder.

Figure 3:
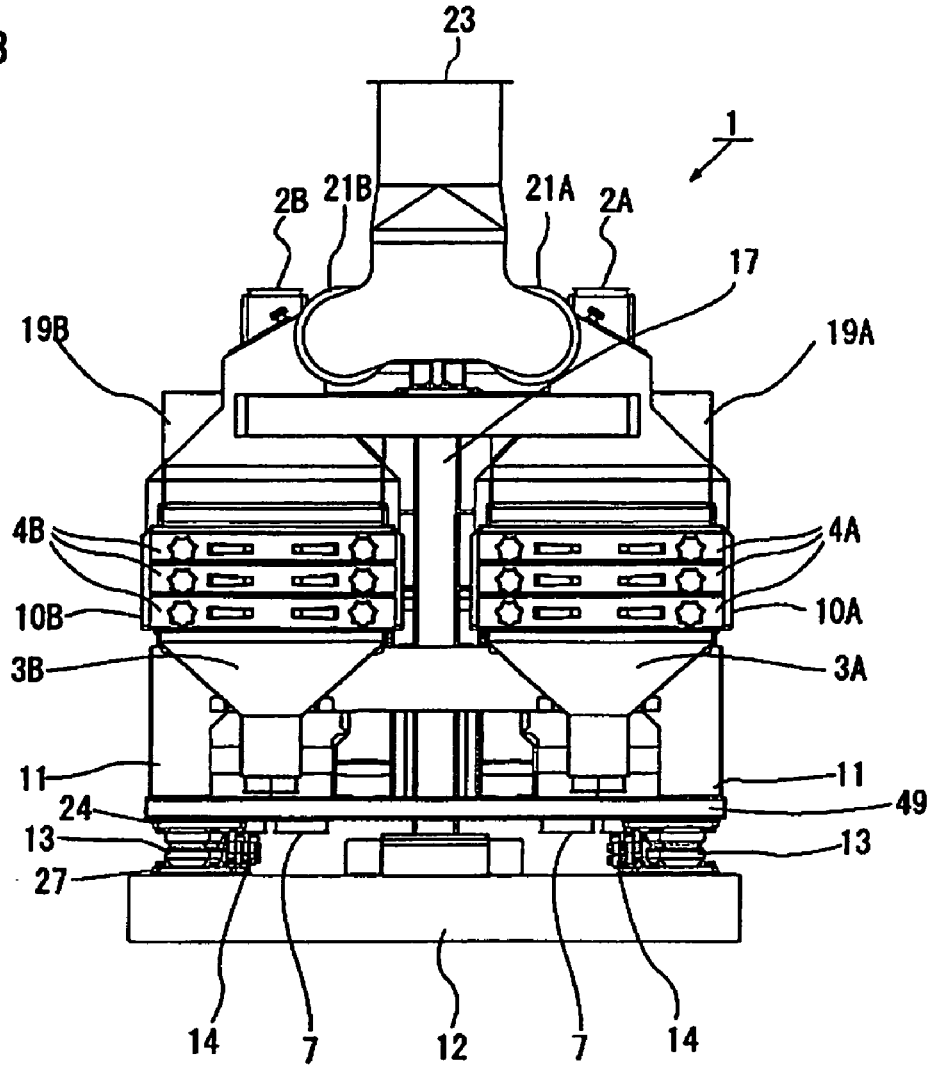
FIG. 3 is a right side view of the purifier.

Next, the structure of the anti-roll member 14 is described (FIGS. 14 to 17). The anti-roll member 14 (FIG. 15) includes an upper base portion 26, a lower base portion 29, a first arm member 30', a second arm member 31', and three link mechanisms 32', 33, and 34'. The upper base portion 26 is fixed to the bottom portion 24 mounted onto a leg 11 with the bolts 25 (FIGS. 1 and 3). The lower base portion 29 is fixed to a bottom portion 27 mounted on the support base 12 with bolts 28. Between the upper base portion 26 and the lower base portion 29, the first arm member 30', the second arm member 31', and three link mechanism 32', 33, and 34' are provided for support.

Figure 15:
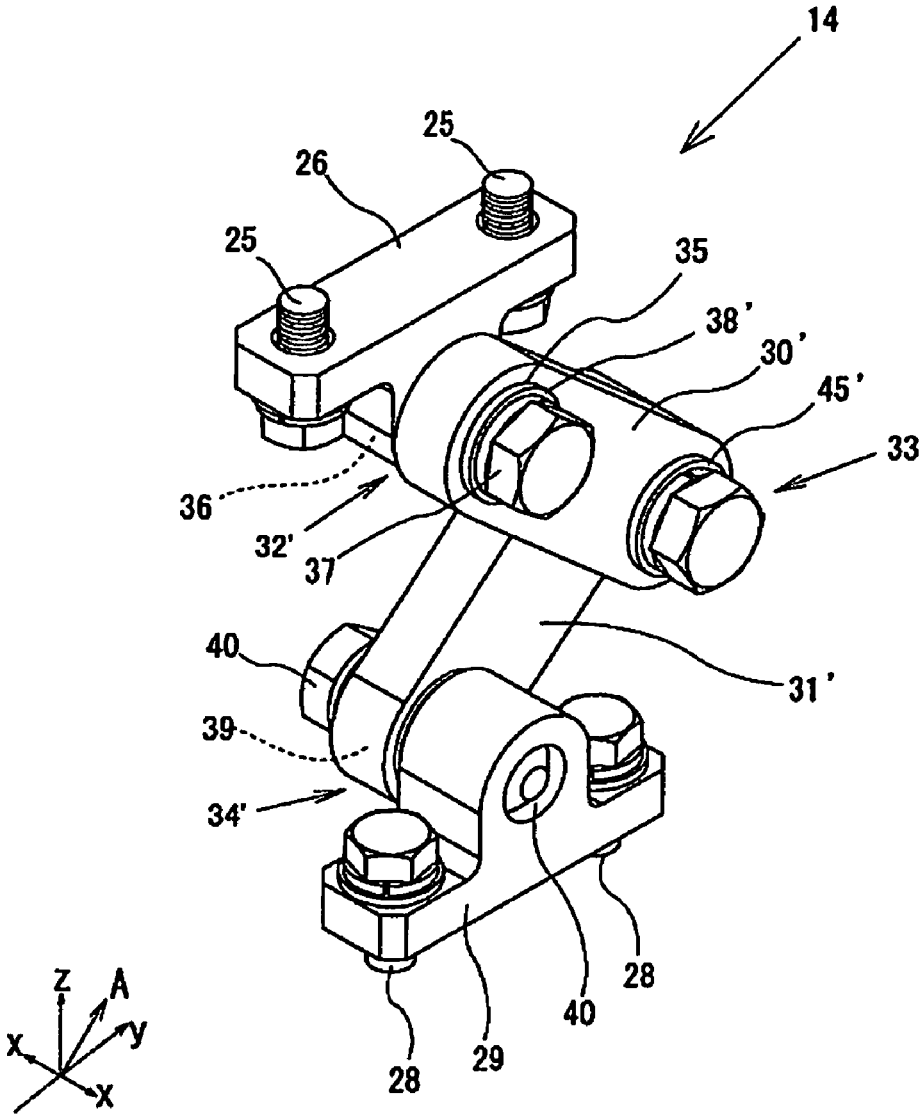
FIG. 15 is a perspective view of an anti-roll member of the present invention.
Figure 16:
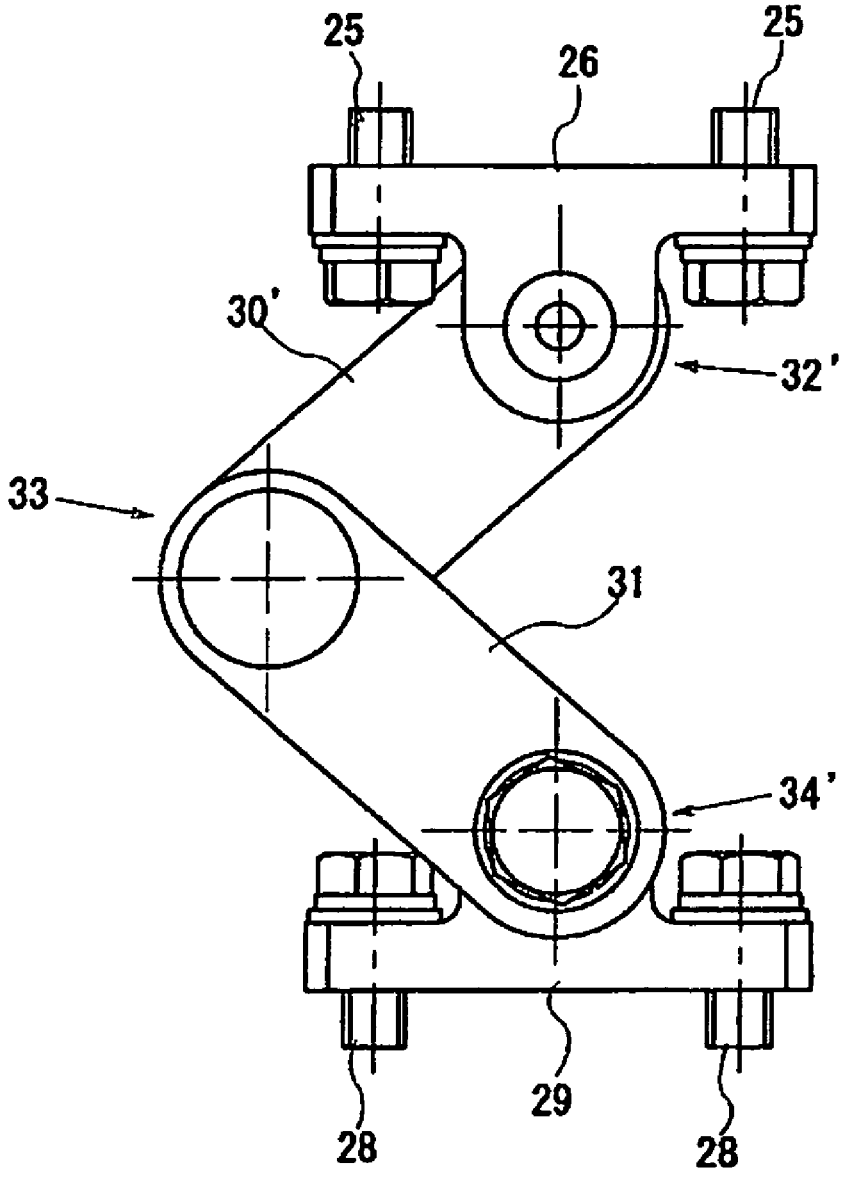
FIG. 16 is a front view of the anti-roll member.
Figure 17:
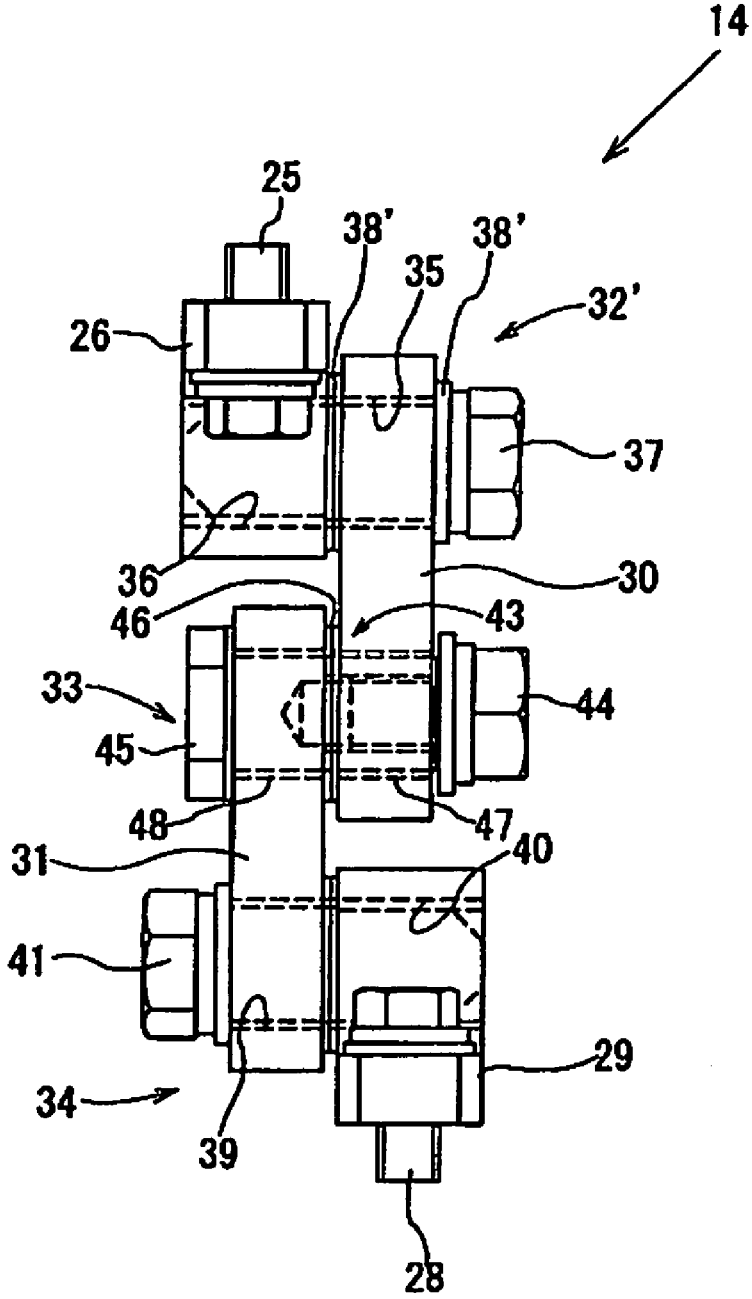
FIG. 17 is a side view of the anti-roll member.
Figure 18:
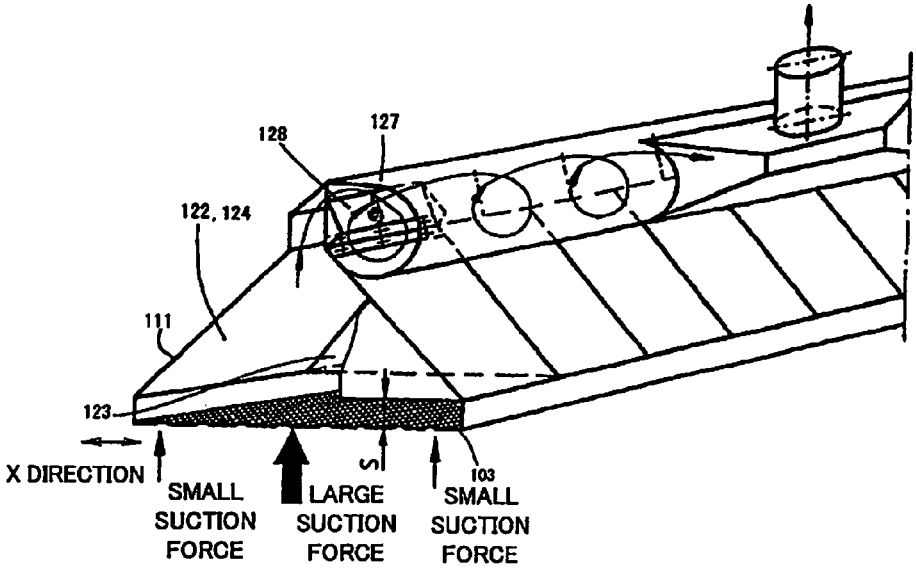
FIG. 18 is a schematic view of an air distribution chamber of a conventional purifier.
Figure 19:
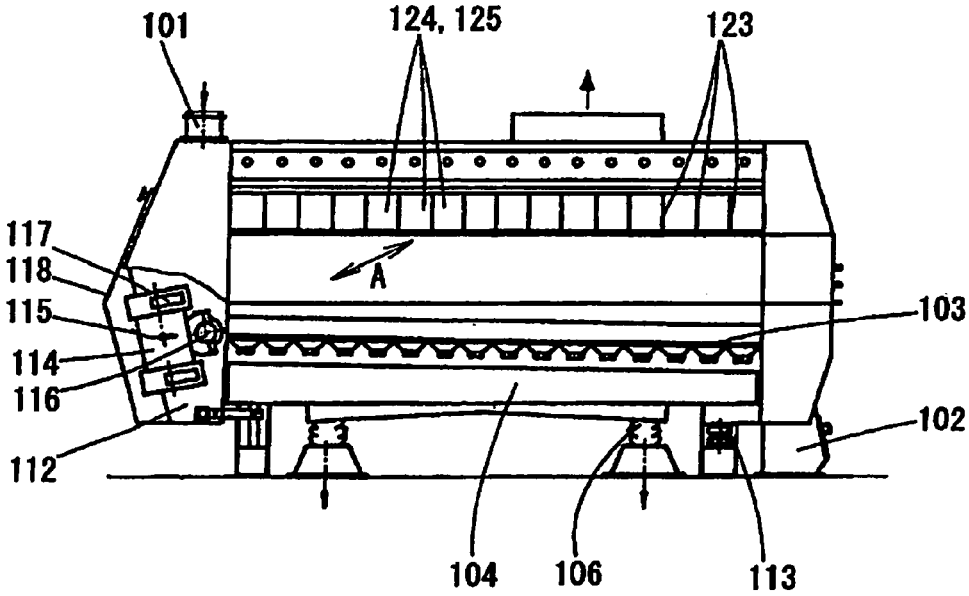
FIG. 19 is a schematic front view of the conventional purifier.
Figure 20:
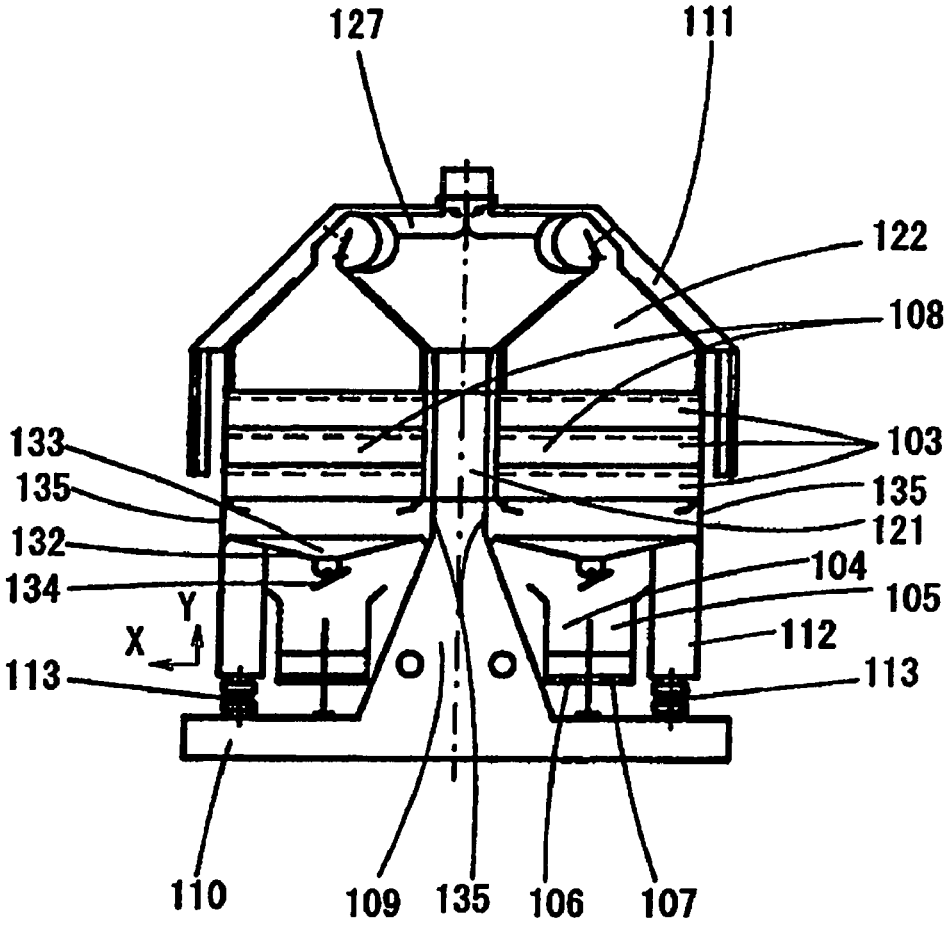
FIG. 20 is a schematic side view of the conventional purifier.

The link mechanism 32' includes a pin hole 35 (refer to FIG. 17) provided by piercing an upper end of the first arm member 30', a pin fit-in portion 36 provided by piercing the upper base portion 26, and a pin member 37 inserted in the pin hole 35 and the pin fit-in portion 36 so that the lower end of the first arm member 30' rotates in a longitudinal direction (a direction indicated by an arrow y in FIG. 15) and a vertical direction (a direction indicated by an arrow z in FIG. 15). Here, a reference numeral 38' denotes a sliding bush. Also, the link mechanism 34' includes a pin hole 39 provided by piercing a lower end of the second arm member 31', a pin fit-in portion 40 provided by piercing the lower base portion 29, and a pin member 41' inserted in the pin hole 39 and the pin fit-in portion 40 so that the upper end of the second arm member 31' rotates in the longitudinal direction (the direction indicated by the arrow y in FIG. 15) and the vertical direction (the direction indicated by an arrow z in FIG. 15). Here, a reference numeral 42 denotes a sliding bush. Furthermore, in the link mechanism 33, a pin hole 47 provided by piercing a lower end of the first arm member 30' and a pin hole 48 provided by piercing an upper end of the second arm member 31' to form an arm joint member 43, with a pin member (a convex portion) 44 and a pin member (a concave portion) 45' being inserted in the arm joint portion 43. Here, a reference numeral 46' is a sliding bush.

All of the pin members 37, 41', 44; and 45' for use in the link mechanisms 32', 33, and 34' are preferably in a lateral direction (the direction indicated by the arrow x in FIG. 15) in a planar view, with the same fitting-in and inserting directions to the pin hole and the pin fit-in portion. That is, while the rotation of the first arm member 30' and the second arm member 31' is regulated in the lateral direction (the direction indicated by the arrow x in FIG. 15), the rotation is allowed in the longitudinal direction (the direction indicated by the arrow y in FIG. 15) and the vertical direction (the direction indicated by the arrow z in FIG. 15). Therefore, the motion of the sieve box 10 coupled to the legs 11 is regulated in the lateral direction, and only the original longitudinal and vertical vibrating directions can be allowed, thereby preventing the occurrence of rolling.

As described above, in the purifier 1, the sieve box 10 is supported by at least four legs 11 onto the support base 12 serving as a non-vibration component, and the anti-roll member 14 that prevents shake in a short-side direction forming a right angle with respect to the longitudinal direction of the sieve box 10 is mounted on each of the legs 11 for supporting the sieve box 10. Therefore, an effect can be achieved such that, even during a period at the time of starting and stopping the operation in which the vibrating direction of the unbalanced vibration generating device 15 is unstable, the original linear vibrating direction (the direction indicated by the arrow A in FIG. 1) can be appropriately oriented and the occurrence of roll of the sieve box 10 in the lateral direction can be prevented.

As a result, the occurrence of rolling is prevented. Therefore, the action of load stress onto a plurality of components as non-vibration components, such as the support base head 19 forming the air distribution 18, is prevented, and the risk of fatigue breakdown is reduced.

Also, the anti-roll member 14 includes the upper base portion 26, the lower base portion 29, the first arm member 30', the second arm member 31', and three link mechanisms 32', 33, and 34'. Therefore, the anti-roll member 14 can be fabricated with a simple component structure, and fabrication cost can also be reduced.

Furthermore, as with the hollow rubber springs 13 as vibrating members, the anti-roll member 14 is mounted between the bottom portion 24 mounted on the leg 11 and the bottom portion 27 mounted on the support base 12. Therefore, by removing the bottom portions 24 and 27, the anti-roll member 14 can be easily taken out of the purifier 1 for easy maintenance. The time required for exchange can also be reduced.

What is claimed is:

1. A purifier in which a plurality of sieve layers stacked each other are accommodated in a sieve box as being mounted in an inclined manner, the sieve box is supported by at least four legs onto a support base as a non-vibration component, the sieve box is coupled to a vibration generating device so as to be able to vibrate in a longitudinal direction of the sieve box and communicates with a unit of supplying a material required to be screened on an upstream side of the sieve box and an overtail discharge unit on a downstream side of the sieve box, a collecting device that collects powder particles falling through sieves is provided below the sieve box, and an air distribution chamber is provided above the sieve box, the air distribution chamber sucking air passing from a lower portion to an upper portion of the sieves, wherein the air distribution chamber is configured of paired inclined surfaces formed as being tapered upward and has a suction passage formed as a horizontal cyclone placed above the air distribution chamber, a plurality of barrier walls are provided in the air distribution chamber in a direction perpendicular to a longitudinal direction of the sieve layers, the air distribution chamber is sectioned by the barrier walls into a plurality of chambers, and rectifying plates are further provided to the air distribution chamber at a narrow position between the paired inclined surfaces to prevent non-uniformity of suction of powder on the sieve layers.

2. The purifier according to claim 1, wherein each of the rectifying plates is formed of a perforated metal, and has a hole diameter in a range of 4.5 mm to 8.0 mm and an aperture ratio in a range of 51% to 45%.

3. The purifier according to claim 1, wherein the air distribution chamber is separately disposed to left and right with respect to a center machine casing, the horizontal cyclone placed above each of the air distribution chambers is provided so as to be deflected toward the center machine casing, and each of the rectifying plates has a rectifying surface inclined toward a direction in which the horizontal cyclone is placed.

4. The purifier according to claim 1, wherein the sieve box is configured to have a rear end face with an opening formed for each layer, the opening from which the sieves can be inserted and removed, the sieve box holds the sieves for each layer in guide rails formed along the longitudinal direction in the sieve box, and sieve fixing means is further provided to the opening, the sieve fixing means closing the opening as pressing a sieve on a lowermost downstream side among the sieves, and the sieve fixing means includes a main body that presses a rear end of the sieve on the lowermost downstream side, a lid member that closes the opening, paired knob bolts that screw between the lid member and the main body so as to be able to adjust a space therebetween to be widened and narrowed, and an elastic member inserted in a screw fit-in portion between the lid member and the main body, and the lid member is further provided with paired closing means capable of closing or releasing the opening with a manual operation.

5. The purifier according to claim 4, wherein, among the sieve fixing means, sieve fixing means for a sieve layer at an upper stage has one overtail discharge outlet formed in a space between the main body and the lid member, sieve fixing means for a sieve layer at a middle stage has two overtail discharge outlets formed to include, in addition to the one discharge outlet, a discharge outlet formed by cutting a rear side of the main body, and sieve fixing means for a sieve layer at a lower stage has three overtail discharge outlets formed to include, in addition to the two overtail discharge outlets, a discharge outlet formed by cutting a front side of the main body, so as to separate overtail for falling down and discharge for each of the sieve layers at the upper stage, the middle stage, and the lower stage.

6. The purifier according to claim 4, wherein a separated-substance discharge gutter for discharging overtail is mounted on a downstream side of the discharge box, a plurality of barrier walls are disposed a predetermined space apart from each other in the separated-substance discharge gutter, and a plurality of branch valves are provided further below the plurality of barrier walls, the branch valves allowing selection from among an option of aggregating overtail at the upper stage, the middle stage, and the lower stage for discharge from one discharge outlet, an option of dividing the overtail at the upper stage, the middle stage, and the lower stage by half for discharge from two discharge outlets, and an option of separating the overtail at the upper stage, the middle stage, and the lower stage for each sieve layer for discharge from three discharge outlets.

7. The purifier according to claim 1, wherein an anti-roll member is inserted in each of the legs supporting the sieve box, the anti-roll member preventing shake in a short-side direction forming a right angle with respect to the longitudinal direction of the sieve box.

8. The purifier according to claim 7, wherein the anti-roll member includes an upper base portion fixed to a bottom portion mounted on the legs, a lower base portion fixed to a bottom portion mounted on the support base, a first arm member and a second arm member that support between the upper base portion and the lower base portion, and three link mechanisms that connect the first arm member and the second arm member between the upper base portion and the lower base portion.

9. The purifier according to claim 7, wherein a hollow rubber spring as a vibrating member is provided in addition to the anti-roll member between the bottom portion mounted on the legs and the bottom portion mounted on the support base.

* * * * *